United States Patent [19]

Parker

[11] Patent Number: 4,988,407

[45] Date of Patent: Jan. 29, 1991

[54] PROCESS AND APPARATUS FOR PRODUCING DRY BLACK LIQUOR SOLIDS

[76] Inventor: Donald I. Parker, Rte. 1, Box 211A, Linwood, N.C. 27299

[21] Appl. No.: 443,590

[22] Filed: Nov. 30, 1989

[51] Int. Cl.[5] ..... D21C 11/12

[52] U.S. Cl. ..... 162/30.11; 162/30.1; 162/31; 162/29; 162/239

[58] Field of Search ..... 162/29, 30.1, 30.11, 162/31, 239, 240; 23/313 FB, 313 P; 44/51, 61, 90; 431/2

[56] References Cited

U.S. PATENT DOCUMENTS

| | | | |
|---|---|---|---|
| 2,586,818 | 2/1952 | Harms | 23/313 FB |
| 4,363,698 | 12/1982 | Nelson et al. | 162/30.11 |
| 4,377,439 | 3/1983 | Lien | 162/30.11 |
| 4,619,732 | 10/1986 | Clay et al. | 162/29 |
| 4,726,908 | 2/1988 | Kruse et al. | 23/313 P |
| 4,775,457 | 10/1988 | Beer et al. | 44/61 |
| 4,865,750 | 9/1989 | Ciriachs et al. | 162/30.1 |

OTHER PUBLICATIONS

Harrison, R. E. et al., Ultra-High-Solids Evaporation of Black Liquor, Tappi Journal, Feb. 1988, pp. 61-66.

Hyoty, P. A. et al., High-Solids Black Liquor Combustion, Tappi Journal, Jan. 1988, pp. 108-111.

*Primary Examiner*—David L. Lacey

*Assistant Examiner*—Todd J. Burns

*Attorney, Agent, or Firm*—Rhodes, Coats & Bennett

[57] ABSTRACT

This invention relates to the production of dry black liquor solids and more particularly to a process and apparatus for producing such solids having a moisture content below five percent water by weight. The process includes supplying a first stream of black liquor having a solids content in a range such that the first stream flows as a viscous liquid, supplying a second stream of black liquor solids having a solids content in a range such that the second stream flows as a friable granular dry solid, and mixing the first and second streams of black liquor solids and producing an output stream having a solids content such that the output stream flows as a dry solid.

8 Claims, 1 Drawing Sheet

PROCESS AND APPARATUS FOR PRODUCING DRY BLACK LIQUOR SOLIDS

FIELD AND BACKGROUND OF INVENTION

This invention relates to the production of dry black liquor solids and more particularly to a process and apparatus for producing such solids having a moisture content below five percent water by weight.

The production of black liquor as a by-product of the manufacture of products by a kraft process is well known, and the use of black liquor solids for combustion in recovery boilers is well documented in prior patents and technical literature. The interested reader is directed to Nelson U.S. Pat. No. 4,363,698; Liem U.S. Pat. No. 4,377,439; an article by Harrison et al entitled "Ultra-high-solids evaporation of black liquor" appearing in the February 1988 TAPPI Journal at pages 61 through 66; and an article by Hyoty et al entitled "High Solids black liquor combustion" appearing in the January 1988 TAPPI Journal at pages 108 through 111 for an understanding of work done prior to the present invention.

As has been recognized (and illustrated by a graph in the Harrison et al publication reproduced here as FIG. 1), black liquor solids have varying characteristics depending upon the water content. Heretofore, conventional practice has been to reduce the water content to a range such that the black liquor solids have a solids content in the range of about 60–65% by weight and then deliver the solids in a pumpable liquid into a recovery boiler where the water is driven off as steam and the solids are burned to provide heat energy and to recover chemicals used in the kraft process. Understandably, the heat energy necessary to drive off the water content imposes a significant burden on the energy balance of the process. Additionally, the balance between oxidizing and reducing conditions within a recovery boiler is delicate and the complications of driving water off and maintaining the necessary conditions often results in emissions from the boiler stack, with those emissions frequently carrying sulfur components and therefor contributing to odors and so called "acid rain" and other effects of pollution.

The Hyoty article, in particular, addresses this latter point, showing (in a graph reproduced here as FIG. 2) that the emission of sulfur is decreased markedly by an increase in the dry solids content of black liquor. As there shown and described, above about drops to essentially zero.

Efforts toward further decreasing the water content and increasing the efficiency of combustion while decreasing emissions have encountered the "sticky tarry" and "umpumpably viscous" ranges of black liquor solids, as shown by the graph of Harrison and described hereinafter. Prior to the present invention, there has been no viable process or apparatus disclosed which enables a leap over these ranges of water content or addresses the handling of black liquor solids as other than a liquid.

BRIEF STATEMENT OF INVENTION

With the foregoing in mind, it is an object of this invention to process black liquor solids in a manner which results in the handling of such materials as a dry, friable solid. In realizing this object of the present invention, the difficulties encountered in attempting to handle and transport to a boiler an unpumpable, highly viscous liquid or a sticky tar are avoided.

Yet a further object of this invention is to provide an apparatus which is capable of producing black liquor solids as a dry, friable solid and of handling such a material using conventional conveyance techniques for such solids. In realizing this object of the present invention, the use of conventional dry materials feeders is enabled and the liquid handling technology used heretofore is rendered unnecessary.

Yet another object of this invention is to reduce the emission of vapor, and of sulfur components carried by such vapor, from recovery boilers used in conjunction with paper mills. In realizing this object of the present invention, a significant contribution is made toward improving the environmental impact of paper mills.

BRIEF DESCRIPTION OF DRAWINGS

Some of the objects of the invention having been stated, other objects will appear as the description proceeds, when taken in connection with the accompanying drawings, in which.

DETAILED DESCRIPTION OF INVENTION

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Figure 1:
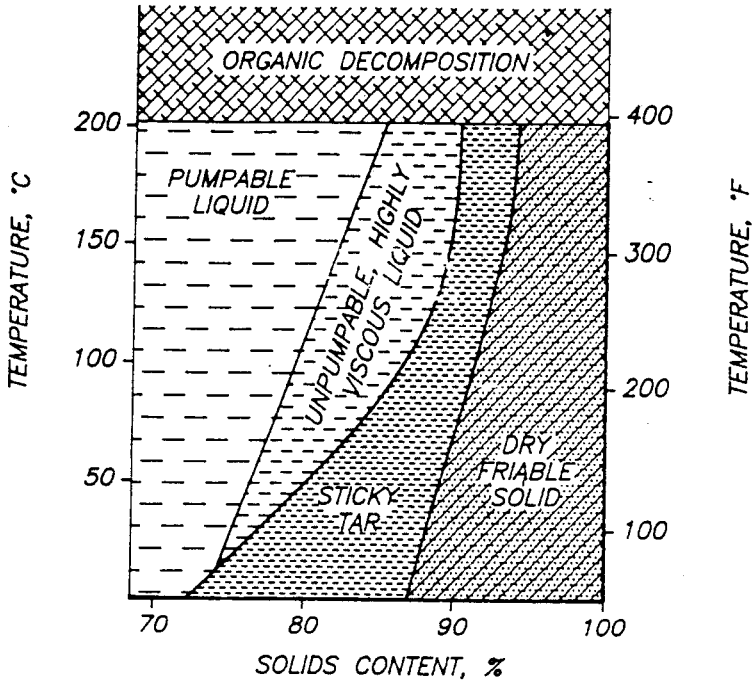
FIG. 1 is a graphic depiction of the characteristics of black liquor solids as functions of temperature and weight percentage of solids content.

Referring now more particularly to the accompanying drawings, FIG. 1 is drawn directly from the Harrison et al publication mentioned above. This Figure illustrates the characteristics of black liquor solids as functions of temperature and weight percent of solids content. As will be noted, most prior discussions of the recovery of energy from black liquor solids has related to operations conducted below such percentages of solids content as result in an unpumpable, highly viscous liquid or a sticky tar. That is, most prior art discussions relate to solids contents below about 70% by weight. The present invention, by way of distinction, offers for the first time a way to leap over the unpumpable liquid, stick tar regions and operate with black liquor solids as a dry, friable solid.

Figure 2:
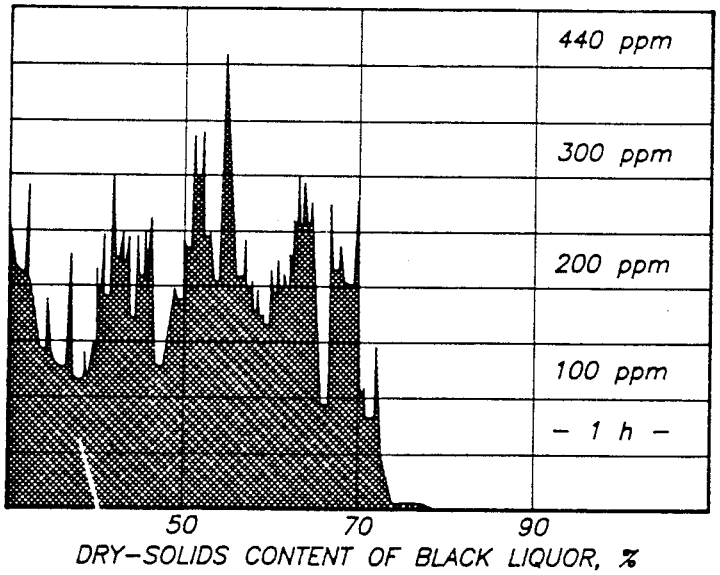
FIG. 2 is a graphic depiction of sulfur emissions as a function of the dry solids content of black liquor.

The advantages of being able to operate in the manner intended by this invention will be clear to the person of appropriate skill in the applicable arts. First, the technologies of moving dry, friable materials are well known, and boiler fuel feeders have been in wide use for burning such dry, friable materials as powdered coal. Such technology is directly adaptable to dry, friable black liquor solids and renders the burning of such material as a fuel much easier. Further, the reduction in the quantities of water to be driven off as vapor has two favorable effects. One is that the thermal recovery is increased immediately. Another is that the emission of vapor, and with it at least the potential effects of emitted sulfur components, is markedly reduced. The latter point is particularly emphasized by FIG. 2, drawn directly from the Hyoty et al article which discusses the advantages in lessened environmental impact which come from higher solids content black liquor.

In accordance with important characterizing features of this invention, black liquor solids having a solids content, by weight percent, above ninety five percent is achieved by a process comprising the steps of supplying a first stream of black liquor having a solids content in a range such that the first stream flows as a viscous liquid, supplying a second stream of black liquor solids having a solids content in a range such that the second stream flows as a friable granular dry solid, mixing the first and second streams of black liquor solids and producing an output stream having a solids content such that the output stream flows as a dry solid, and drying the output stream of black liquor solids and raising the solids content to a range such that the output stream flows as a friable granular dry solid. Such a process or series of steps may operate with materials of particular contents, such as by supplying a first stream of black liquor having a solids content in a range of less than 80% solids by weight, and supplying a second stream of black liquor solids having a solids content in the range of at least about 95% solids by weight, and then mixing the first and second streams of black liquor solids and producing an output stream having a solids content in the range of at least about 90% solids by weight, and drying the output stream of black liquor solids and raising the solids content to a range of at least about 95% solids by weight.

Figure 3:
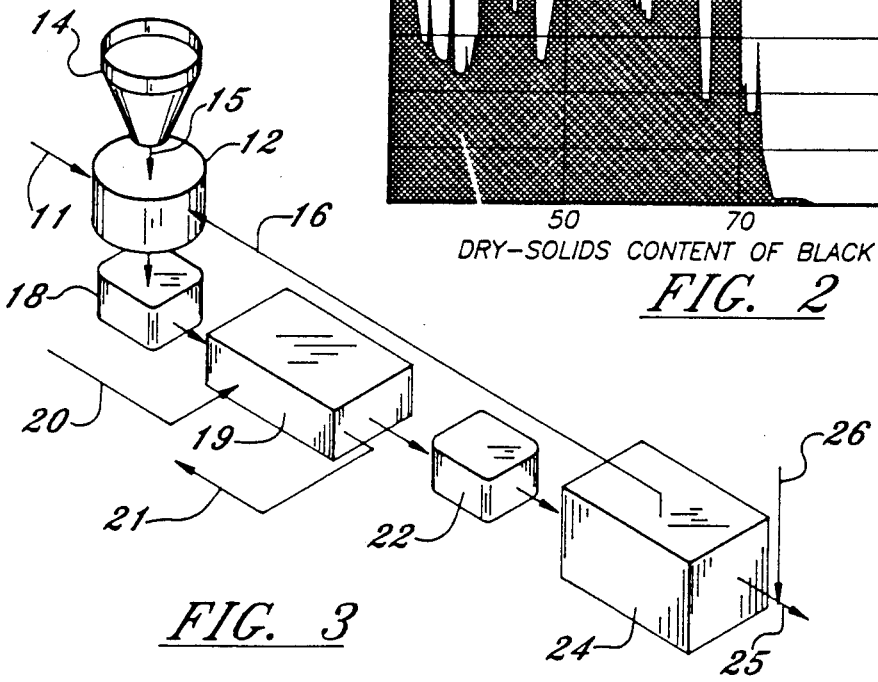
FIG. 3 is a schematic representation of an apparatus and the process flow of materials in accordance with this invention.

In particular, and with reference to FIG. 3 of the accompanying drawing, such a process may deliver the first stream through a suitable conduit indicated generally at 11 into a mechanical mixer indicated generally at 12 for blending the black liquor solids of the first stream into the black liquor solids of the second stream. The second stream may be delivered from a startup storage bin indicated generally at 14 or from the end of the process as described hereinafter into the mixer 12, through conduits indicated generally at 15 and 16.

After mixing in the mixer 12, the black liquor solids will have been raised to a solids content, as a weight percent, which is in the dry friable solid range as shown in FIG. 1. Thus the materials will have been adapted to handling by an appropriate dry materials feeder 18 by which the material may be advanced to a drier 19. The drier 19 is supplied with steam through appropriate conduits 20 and condensate and other vapor is removed through appropriate exhaust conduits, one of which is shown at 21, for further production of steam or for condensation and potential return to the paper making process. As will be understood, the drier 19 is heated for subjecting the output stream to elevated temperatures for driving off moisture.

From the drier 19, the black liquor solids which have been raised to a solids content of at least about ninety five percent by weight are delivered by another mechanical feeder 22 to a storage bin or the like generally indicated at 24 and thence through an appropriate conduit indicated at 25 into a recovery boiler for combustion.

As the solids are delivered for combustion, additional chemicals appropriate to correct any chemical imbalances of effluents being returned to the mill processes may be delivered through a conduit indicated generally at 26. As will be appreciated by a knowledgeable reader, it has heretofore been the practice to add "salt cake" (usually sodium sulfate) to black liquor solids being processed in a recovery boiler. The present invention contemplates that such additions may be made wherever appropriate or convenient in the process and apparatus, including the point indicated and at other points where prior mill practice may have found such additions desirable. The present invention also contemplates that such additions may be undesirable or unnecessary for certain mill processes, while the remainder of this invention will find utility apart from such additions.

In the drawings and specifications there has been set forth a preferred embodiment of the invention and, although specific terms are used, the description thus given uses terminology in a generic and descriptive sense only and not for purposes of limitation.

What is claimed is:

1. In a process for producing dry black liquor solids the improvement comprising the steps of:

supplying a first stream of black liquor having a solids content in a range such that the first stream flows as a viscous liquid, supplying a second stream of black liquor solids having a solids content in a range such that the second stream flows as a friable granular dry solid, mixing the first and second streams so as to produce an output stream having a solids content such that the output stream flows as a dry solid, drying the output stream of black liquor solids and raising the solids content to a range such that the output stream flows as a friable granular dry solid, and returning a portion of the dried output stream of black liquor solids to said second stream of black liquor solids.

2. In a process for producing dry black liquor solids the improvement comprising the steps of:

supplying a first stream of black liquor having a solids content in a range of less than 80% solids by weight, supplying a second stream of black liquor solids having a solids content in a range of at least about 95% solids by weight, mixing the first and second streams so as to produce an output stream having a solids content in the range of at least about 90% solids by weight, drying the output stream of black liquor solids and raising the solids content to a range of at least about 95% solids by weight, and returning a portion of the dried output stream of black liquor solids to said second stream of black liquor solids.

3. A process according to one of claim 1 or claim 2 wherein said step of mixing the first and second streams comprises delivering the streams into a mechanical mixer for blending the black liquor solids of the first stream into the black liquor solids of the second stream.

4. A process according to claim 1 or claim 2 wherein said step of drying the output stream of black liquor solids comprises delivering the output stream through a mechanical feeder into a heated dryer and subjecting the output stream to elevated temperatures for driving off moisture.

5. A process according to claim 1 or claim 2 further comprising the step of delivering the dried output stream for combustion in a recovery boiler.

6. A process according to claim 5 further comprising the step of adding to at least one of the streams before delivery of the dried output stream to combustion, chemical constituents appropriate for restoring chemical balance to effluents to be returned to a kraft pulping process for the manufacture of paper.

7. In a process for producing black liquor solids the improvement comprising the steps of:

supplying a first stream of black liquor having a solids content in a range such that the first stream flows as a viscous liquid, supplying a second stream of black liquor solids having a solids content in a range such that the second stream flows as a friable granular dry solid, delivering the streams into a mechanical mixer for blending the black liquor solids of the first stream into the black liquor solids of the second stream and thereby mixing the fist and second streams so as to produce an output stream having a solids content such that the output stream flows as a dry solid, delivering the output stream through a mechanical feeder into a heated dryer and subjecting the output stream to elevated temperatures for driving off moisture and thereby drying the output stream of black liquor solids and raising the solids content to a range such that the dried output stream flows as a friable granular dry solid, returning a portion of the dried output stream of black liquor solids to said second stream of black liquor solids, and delivering the remaining portion of the dried output stream for combustion in a recovery boiler.

8. In a process for producing dry black liquor solids the improvement comprising the steps of:

supplying a first stream of black liquor having a solids content in a range of less than 80% solids by weight, supplying a second stream of black liquor solids having a solids content in a range of at least about 95% solids by weight, delivering the streams into a mechanical mixer for blending the black liquor solids of the first stream into the black liquor solids of the second stream and thereby mixing the first and second streams so as to produce an output stream having a solids content in the range of at least about 90% solids by weight, delivering the output stream through a mechanical feeder into a heated dryer and subjecting the output stream to elevated temperatures for driving off moisture and thereby drying the output stream of black liquor solids and raising the solids content to a range of at least about 95% solids by weight, returning a portion of the dried output stream of black liquor solids to said second stream of black liquor solids, and delivering the remaining portion of the dried output stream for combustion in a recovery boiler.

* * * * *